United States Patent [19]

Ozawa et al.

[11] Patent Number: 4,942,373

[45] Date of Patent: Jul. 17, 1990

[54] THIN FILM DELAY LINES HAVING A SERPENTINE DELAY PATH

[75] Inventors: Paul Ozawa; Mark Brooks; Fumitoshi Nakanata, all of North Mankato, Minn.

[73] Assignee: Thin Film Technology Corporation, North Mankato, Minn.

[21] Appl. No.: 180,353

[22] Filed: Apr. 11, 1988

[30] Foreign Application Priority Data

Jul. 20, 1987 [JP] Japan ..... 62-181877
Oct. 14, 1987 [JP] Japan ..... 62-258645

[51] Int. Cl.[5] ..... H01P 9/00
[52] U.S. Cl. ..... 333/161; 336/200
[58] Field of Search ..... 333/161, 164, 156, 140, 333/23; 336/200, 232

[56] References Cited

U.S. PATENT DOCUMENTS

| | | | |
|---|---|---|---|
| 2,832,935 | 4/1958 | Tank | 333/140 |
| 3,005,966 | 10/1961 | Strom | 333/140 X |
| 3,257,629 | 6/1966 | Kornreich | 333/161 |
| 4,203,081 | 5/1980 | Braeckelmann | 333/140 X |
| 4,626,816 | 12/1986 | Blamkin | 536/200 X |
| 4,641,113 | 2/1987 | Ozawa | 333/161 |
| 4,641,114 | 2/1987 | Person | 333/161 |

FOREIGN PATENT DOCUMENTS 632834 12/1949 United Kingdom ..... 333/161

OTHER PUBLICATIONS

Fonatsch, H. A. et al.; "Continuously Variable Electrical Delay Line"; *IBM Technical Disclosure Bulletin;* vol. 6, No. 1, Jun. 1963; pp. 64, 65.

*Primary Examiner*—Eugene R. Laroche
*Assistant Examiner*—Benny Lee
*Attorney, Agent, or Firm*—Douglas L. Tschida

[57] ABSTRACT

Multi-layered, thick/thin film, nanosecond delay lines, the inductive/capacitive characteristics of which are tailored to provide line impedances yielding unit delays of 1 to 10 nanoseconds. The delay lines are constructed on a supporting ceramic, resin/fiber or plastic substrate. In alternative embodiments, a serpentine conductive layer of tailored line widths and conductor spacings is sandwiched relative to overlying dielectric layers of 25 to 200 microns thickness and associated ground plane layers. In another embodiment, multiple conductor layers are sandwiched relative to intervening dielectric and ground plane layers. Lateral contact pads/pins, vertical vias and jumper conductors permit circuit connection and interconnection of the layers.

14 Claims, 6 Drawing Sheets

THIN FILM DELAY LINES HAVING A SERPENTINE DELAY PATH

FOREIGN APPLICATION PRIORITY DATA

Applicant claims the benefits of the following prior foreign applications:

(1) Japanese Application Ser. No. 258645/1987, filed Oct. 14, 1987;

(2) Japanese Application Ser. No. 181877/1987, filed July 20, 1987 and assigned to Thin Film Technology Corporation, North Mankato, Minn.

BACKGROUND OF THE INVENTION

The present invention relates to conductive/inductive transmission lines and, in particular, to discrete thin and thick film components having predetermined signal delay characteristics determined from tailored inductive/capacitive impedance characteristics and providing unitary nanosecond delays which components may be used to populate conventional printed circuit (PC) boards.

With the ever constant pressure to improve the speed performance of a wide variety of digital and analog switching and signal processing technologies, a need exists for high reliability, nanosecond delay lines to accommodate certain precision timing requirements of such circuit designs. Although a wide variety of techniques and technologies have been used to develop precise time interval defining circuits, they have been principally directed to relatively long duration delays in the millisecond to microsecond range, have required a number of circuit components to implement and/or are relatively costly. In contrast and in many circumstances a high precision, small size discrete component, nanosecond delay line is preferred.

One transmission line type delay element of which Applicant is aware and which Applicant currently produces comprises a discrete packaged assembly having a serpentine patterned conductive layer plated/etched onto one side of a relatively thick, dielectric substrate and on an opposing side of which is formed a ground plane. The substrate is used not only as a mechanical support but also for its dielectric properties to separate the ground plane from the serpentine conductor. Although requiring relatively few layers, this construction is limited in the magnitude of delay which is achievable which typically does not exceed 1.7 nanoseconds. Unit delays for a similar single conductor layer of predetermined length and package size on the order of 5 to 10 nanoseconds are preferred. An improved delay range particularly increases the range of components which may be constructed relative to an end user's circuit designs.

The particular limitation which Applicant believes has heretofore limited its ability to achieve an increased range of delay values has resulted from an inability to obtain suitable dielectric substrates thinner than 0.4 millimeters. In particular, the relatively thick dielectric has constrained the conductor widths and spacings to the point where the device's inductive and capacitive characteristics provide for a combined device impedance which is insufficient to achieve the preferred delays. That is, with a thinner dielectric the device's capacitive characteristics vis-a-vis the ground plane and inductive characteristics vis-a-vis the windings of the serpentine conductor may be tailored to increase the device's measured overall impedance ($Z_0$) and resultant time delay.

One other construction of which Applicant is aware is produced by Valor Electronics, but which is constructed more in the fashion of a coiled so-called "lumped constant" LC configuration. Such devices however do not lend themselves to the range of delays which Applicant now seeks, to obtain, and rather find use where delays greater than 10 nanoseconds are required. They also tend to exhibit poor temperature coefficients and are more commonly constructed from discrete inductor and capacitive components, rather than as film devices.

SUMMARY OF THE INVENTION

In lieu, therefore, of the above-mentioned construction, the present invention contemplates a transmission line type of packaging configuration providing for an independent mechanical support substrate and relatively thin dielectric layers of 25 to 200 micron thicknesses and conductor patterns of 50 to 250 micron line widths and 50 to 600 micron line spacings in single or multi-layered configurations which result in tightly toleranced thin film components capable of unit delay values in the range of 1 to 5 nanoseconds and device delays less than 10 nanoseconds. A step and repeat type of processing is thereby also implementable during construction. The relatively thin dielectric layers are sandwiched between each patterned signal layer and the ground plane is mounted amongst or on top of the signal layers in lieu of on the opposite side of the substrate.

It is accordingly a primary object of the present invention to provide a modularly constructed delay line adaptable to a step and repeat construction methodology using currently available technologies and fabrication equipment whereby precisely toleranced, discrete nanosecond delay lines may be fabricated.

It is a further object of the invention to provide a construction incorporating standardized, patterned conductor or conductive/inductive signal layers relative to adjacent relatively thin dielectric and/or ground plane layers.

It is a still further object to provide a construction readily implementable with, among others, conventional photolithographic/plated printed circuit, vapor deposition, laminating and sputtering fabrication technologies and equipment.

Various of the foregoing objects and advantages are particularly achieved in the present invention which in a number of alternative embodiments discloses discrete nanosecond delay lines which are formed on supporting insulator substrates. In one embodiment, a composite serpentine signal layer is plated/etched over a sputtered base layer and an underlying nickel-chrome adhesion layer sputtered onto a ceramic substrate. Successively overlying silk-screened dielectric, plated, ground plane and cured epoxy passivation layers, along with necessary contact pins, complete the assembly.

In another embodiment, the conductive signal layer is plated onto a resinous/fiber substrate and etched down to a desired serpentine signal layer configuration and length. Successively deposited thereover are overlying silkscreened/laminated polyimide dielectric and conductive ground plane layers. In a third embodiment, successively stacked patterned signal layers, intervening dielectric layers and ground plane layers are applied to provide delay times of tailored durations and/or multiple delay outputs.

In still another stacked embodiment using laminated conductors, vias let through the substrate connect unitary signal layers formed on opposite sides of the substrate relative to adjacent dielectric and ground plane layers. Alternatively the vias interconnect layers on one side or the other.

The foregoing, objects, advantages and distinctions of the present invention, among others, as well as the details of the construction of each of the foregoing embodiments, among still others, will become more apparent hereinafter upon reference to the following detailed description thereof with respect to the appended drawings. Before referring thereto, it is to be appreciated that the following description is made by way of the presently preferred embodiments only and considered modifications thereto. The description should not be strictly construed, but rather is intended to be illustrative of the spirit and scope of the invention as claimed hereinafter.

DESCRIPTION OF THE PREFERRED EMBODIMENT

Figure 1:
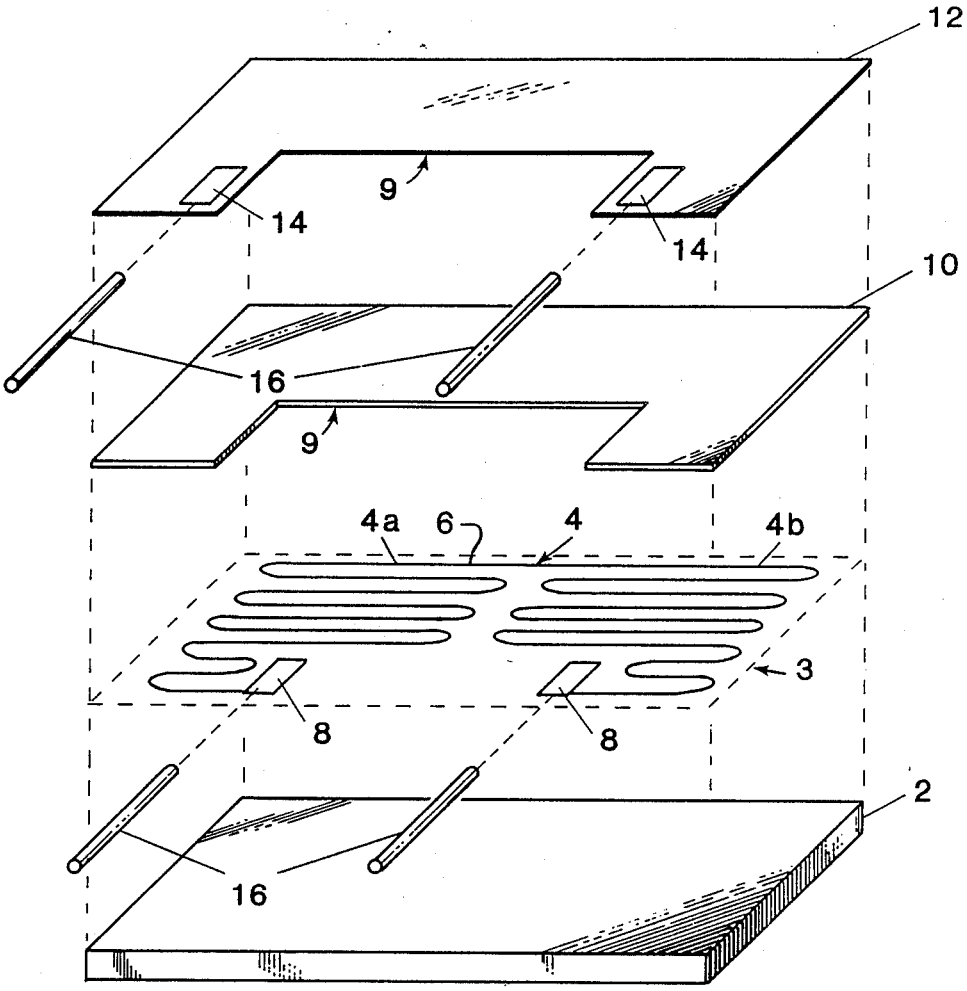
FIG. 1 shows an exploded assembly view of a first preferred embodiment of the present invention.
Figure 1A:
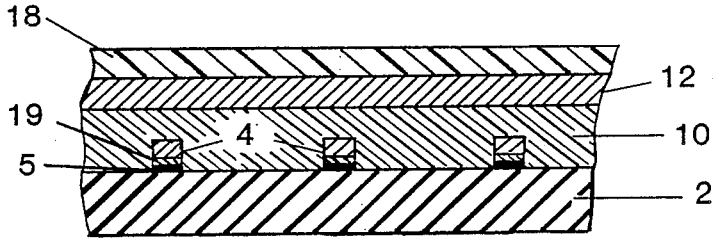
FIG. 1*a* shows a typical cross-section view taken through a typical assembly like that of FIG. 1.
Figure 2:
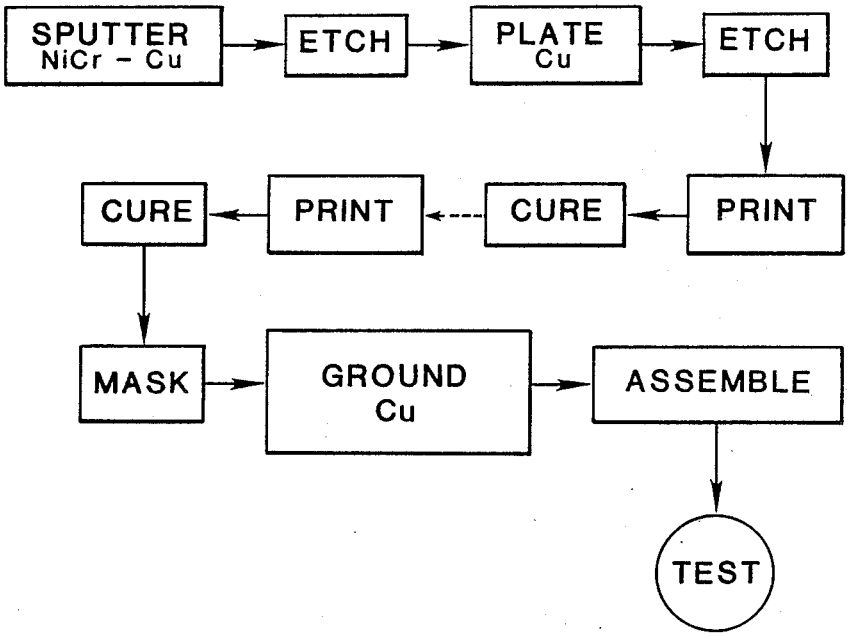
FIG. 2 shows a process flow diagram of the methodology used to construct the assembly of FIG. 1.

Referring to FIG. 1, a view is shown of one embodiment of the present invention in exploded assembly and the procedural process steps of which construction are shown in block diagram form in FIG. 2. In particular, FIG. 1 shows each of the signal, dielectric and ground planes of a delay line assembly 1, prior to packaging and assembly into discrete component form. The particular steps for producing the assembly 1, including the packaging steps, are shown in FIG. 2. To the extent other available processing methodologies might be substituted, they are referenced as appropriate.

The embodiment shown in FIGS. 1 and 2 is constructed on a ceramic substrate 2 of approximately 0.4 mm thick alumina-oxide ($Al_2O_3$); although, it is to be recognized any number of other ceramics or resin/fiber printed circuit board materials or possibly an electrically insulative plastic, such as PTFE, might be used. The relative thickness of these boards may be adjusted in a range of 0.1 mm to 1.0 mm so long as the substrate provides sufficient mechanical support for the assembly 1 during processing and is electrically inert to the applied signals. At present, however, the thinnest available ceramic substrates are on the order of 0.4 mm.

The relative width and length dimensions of the substrate 2 may also be adjusted depending upon the component being fabricated, and the deposition or layering technique employed and available equipment (i.e. plating, sputtering, evaporation, spin coating, plasma deposition, screen printing, spray, electroless plating, lamination et al.) relative to the conductor and dielectric layers. For the embodiment of FIG. 1, however, a sputtered/plated conductor or signal layer 3 is shown and thus the relative dimensions of the substrate 2 are constrained by the dimensional limitations of the sputtering chamber.

Depending upon the particular delay required, a suitably selected conductive material is deposited or layered uniformly over the upper surface of the substrate 2 to a suitable thickness. The inductive/capacitive characteristics of this material are, in turn, tailored as desired relative to the other layers to be applied to provide a desired overall device impedance. In this regard, it is to be appreciated that once a specific configuration is obtained and a range of possible delays determined, any number of specifically desired delays can thereafter be obtained by varying the line length.

For the delay lines of the present invention which are constructed to operate in the range of 1 to 10 nanoseconds and, in particular, the construction of FIG. 1, a composite thin film in the range of 20 to 100 microns is sputtered/plated onto the substrate 2 (reference FIG. 2). A 99+% pure copper conductor layer is used, although it is to be appreciated that a variety of other conductors such as silver, gold and/or alloys thereof may equally be used and tailored to the desired component parameters. Similarly and as will become more apparent, the signal layer 3 may be applied by lamination, screen printing, evaporation or any of a number of available technologies, some of which are mentioned herein, among others which are known to those skilled in the art.

As mentioned, and with additional attention to FIG. 1(*a*) the present conductor o signal layer 3 comprises a composite of a number of layers. Specifically and prior to the sputtering of a copper undercoat layer 19, a nickel-chrome adhesion layer 5 approximately 200 to 500 angstroms thick is deposited over the substrate 2 which facilitates the mechanical bonding of the copper conductive layer to the substrate 2. The necessity of such a bonding layer and the type of alloy depend on the choice of materials for the substrate and conductor layers 2, 3.

Upon depositing a uniform NiCr thin film, and before venting the vacuum chamber, a copper undercoat layer 19 approximately 1000 to 2000 angstroms thick is deposited over the field; again, though, other conductors might be substituted for copper. The coated substrate is then removed from the sputtering chamber, a negative photoresist laminate or a positive dip coated resist is applied and photolithographically processed to provide a desired serpentine conductor pattern 4 thereover (reference FIG. 2).

As shown in FIG. 1, the pattern 4 is comprised of two complimentary halves 4*a*, 4*b* which are electrically coupled to one another by a common conductive path 6 and which terminate in side positioned contact pads 8.

The particular configuration of the serpentine path 4 may be tailored as desired with the windings spaced-out in any variety of fashions. Generally, though, the conductive path 4 of the disclosed embodiment provides for 60 to 250 micron line widths at 50 to 600 micron spacings between lines. Depending upon the tolerances of the pattern processing technology used and the desired inductive and capacitive device characteristics, these dimensions may be varied. However at least for the present construction, delays of up to 5 nanoseconds per signal layer 3 have been achieved with a photolithographic process.

After applying and processing the photoresist, the assembly is placed in a copper sulfate plating bath at 1.5 amperes for 60 minutes to plate-up the patterned conductors 4 through the patterned photoresist to a thickness in the range of 30 to 100 microns or the point where they provide desired electrical properties and mechanical strength. Thus, the plating duration may be varied over an empirically determined range.

The assembly is then run through a developer to remove the resist, prior to etching away the field copper undercoat and field nickel-chrome adhesion layers to produce the desired conductor pattern 4. This etching step occurs in a bath having a concentration of 24% hydrochloric acid, 37–5% zine chloride, 25% copper sulfate and water at a conveyor rate of 60 to 100 inches/minute and at a bath temperature of 30 degrees Centigrade. Thus, during the plating step, it is to be appreciated a slight overplating is performed to account for the material lost when the field layerings are removed. Once the etching in completed, only the conductive pattern 4 and contact pads 8 shown for signal layer 3 remain.

With continuing attention to FIG. 2, a desired dielectric material is next applied over the exposed conductor or signal layer 3 which for the embodiment of FIG. 1 is a polyimide dielectric; although, again, any number of available dielectric materials, such as epoxies, plastics, teflon, polypropylene, polyethylene, acrylic, glass, enamel et al. might be used. In particular, though, a Relyimide 600 TM dielectric material is screen-printed over the exposed conductor pattern 4, except for the contact area 9 which is masked off with the screen during printing. The coated dielectric is then cured for approximately 3 minutes at 175 degrees Centigrade to form the dielectric layer 10 shown in FIG. 1. Because each screen printing deposits only approximately a 30 micron layer, this step is repeated as necessary to achieve a desired dielectric thickness of 30 to 150 microns and a desired dielectric coefficient value. The thickness, again, is dependent upon the patterned conductor thickness and spacing.

The dielectric constant value for the above polyimide material is approximately 3 to 4 and, in particular, for the embodiment of FIG. 1, the dielectric layer 10 is formed to a 30 micron thickness and provides a dielectric constant of 3.9.

Applicant also contemplates doping the dielectric material with a magnetic dopant, such as a nickel powder, to increase the dielectric constant or epsilon value of the material and further improve device operating characteristics at high frequencies. Improvements of 5 to 10% in the device delay times have been achieved with this doping technique.

The exposed dielectric layer 10 is next subjected to a series of steps for producing the ground plane layer 12 and necessary contact pad regions 14 thereto. Prior thereto, a polyimide tape is applied to the contact region 9 to mask off the contact pads 8. A ground plane layer 12 comprised of copper is then evaporated or sputter deposited, etc. in conventional fashion. The thickness of the ground plane 12 is formed in the range of 20 to 80 microns to produce a resistance value on the order of 0.05 to 0.1 ohms. Although a copper ground plane 12 is presently used, nickel, silver, gold or alloys of these materials or still other conductors might be used.

Upon removing the masking tape, and at the end of the process of FIG. 2 the contact pins 16 are solder bonded with a high temperature solder at a temperature in the range of 200 to 250° Centigrade to the contact pads 8 and 14 of the delay line and ground layers 4, 12. The entire assembly is then dipped in a dry overcoating material such as an epoxy powder which is cured to form a hard protective shell around the entire assembly. Alternative passivation or encapulation layers 18, which can be seen from FIG. 1(*a*) might be achieved with variety of other available potting or molding compounds. The assembly is next marked and tested to confirm its electrical characteristics.

For early prototype samples using a patterned transmission line length in the range of 1300 to 1400 mm and the following relative impedance values for the overall device, transmission line and ground plane 1, 4 and 12, Table 1 below shows sampled time delay values which have been obtained:

TABLE 1

| Sample | Delay (nanosecond) | Zo (ohms) | T Line (ohms) | Ground (ohms) |
|---|---|---|---|---|
| 1 | 8.7 | 75 | 35.1 | 0.34 |
| 2 | 8.6 | 75 | 25.4 | 0.35 |

The overall size of the discrete components fabricated were on the order of 25 mm in length by approximately 7 mm in height, although it is anticipated the dimensions will be reduced. Additionally and although shown as if constructed as a single device, it is to be appreciated a number of delay lines might be fabricated at the same time in a matrix configuration on the single substrate 2. Once processed, the substrate 2 may then be diced to size with each die being separately packaged.

Figure 3:
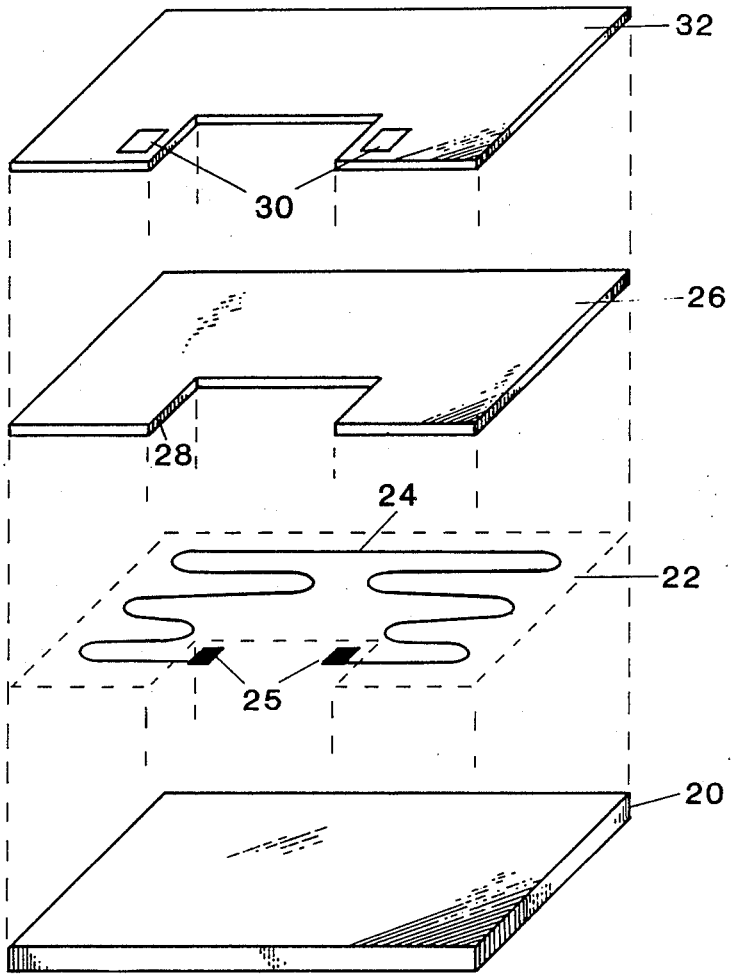
FIG. 3 shows an exploded assembly view of a second embodiment of the invention.
Figure 4:
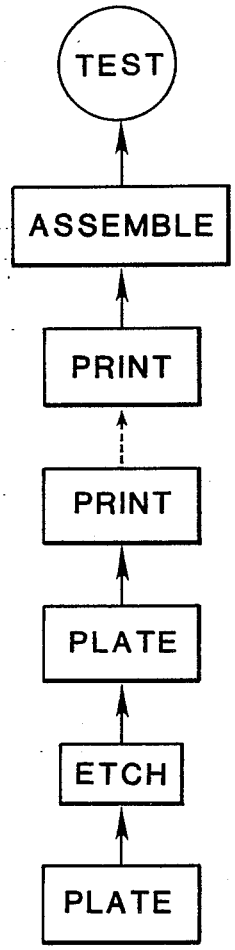
FIG. 4 shows a partial process flow diagram of the methodology used to construct the assembly of FIG. 3.

Referring next to FIGS. 3 and 4, respective exploded assembly and block diagram views are shown of another embodiment of the invention. In lieu of sputtering the conductive layer onto the substrate 20, the conductive signal layer 22 is applied by plating. That is, the substrate 20 which comprises a conventional printed circuit board fiber/resin material is initially cut to a desired size and plated over with copper to a thickness of 1 to 80 microns. Alternatively, the conductor layer may be sputtered or laminated onto the substrate 20. Again, though, the electrical characteristics and thickness of the copper or other applied conductor is controlled by design selection.

A suitable positive or negative photoresist is next applied and photolithographically processed. As above noted, in lieu of patterning a single device, a number of identical cells may be patterned off over the face of the substrate 2 and processed at the same time. In any case, though, the assembly is then run through a suitable developer and acid etch baths to etch away the resist and exposed field copper to form the desired conductive pattern 24. In short, the conductive layer 24 is formed by etching the copper 22 down to a desired thickness and geometry, as opposed to building the conductive layer 3 up to a specific thickness as in the embodiment of FIG. 1.

As before, the contact pads and contact region 28 are next masked off with the screen and a polyimide dielectric layer 26 is silk screen printed over the conductive layer 22, cured and processed to expose the contact pads 26 of the delay line layer 22. Added as desired to the printed dielectric is a magnetic dopant, which depending upon the frequency range of the applied signals, may comprise a number of different dopants. Nickel finds advantage with frequencies up to 10 gigahertz, but iron and cobalt may be used equally for lower frequencies up to 100 megahertz.

Evaporated over the conductive dielectric layer 26, except in the region 28, is a ground plane 32 which for the embodiment of FIG. 3 is formed of nickel having a 99%+ purity. Contact pads 30, adjacent the edge above the contact pads 25, facilitate electrical bonding to the ground plane 32. Alternatively, a copper ground plane may again be used, but nickel facilitates processing by reducing attendant labor steps. It is applied using conventional technologies, and in combination with the copper signal layer 22 and doped or undoped dielectric layer 24 has, as mentioned, been found to provide comparable operating characteristics to the embodiment of FIG. 1 for sampled components. Where a magnetic dopant has been used, improved delays of 5 to 10% have been obtained.

Figure 5:
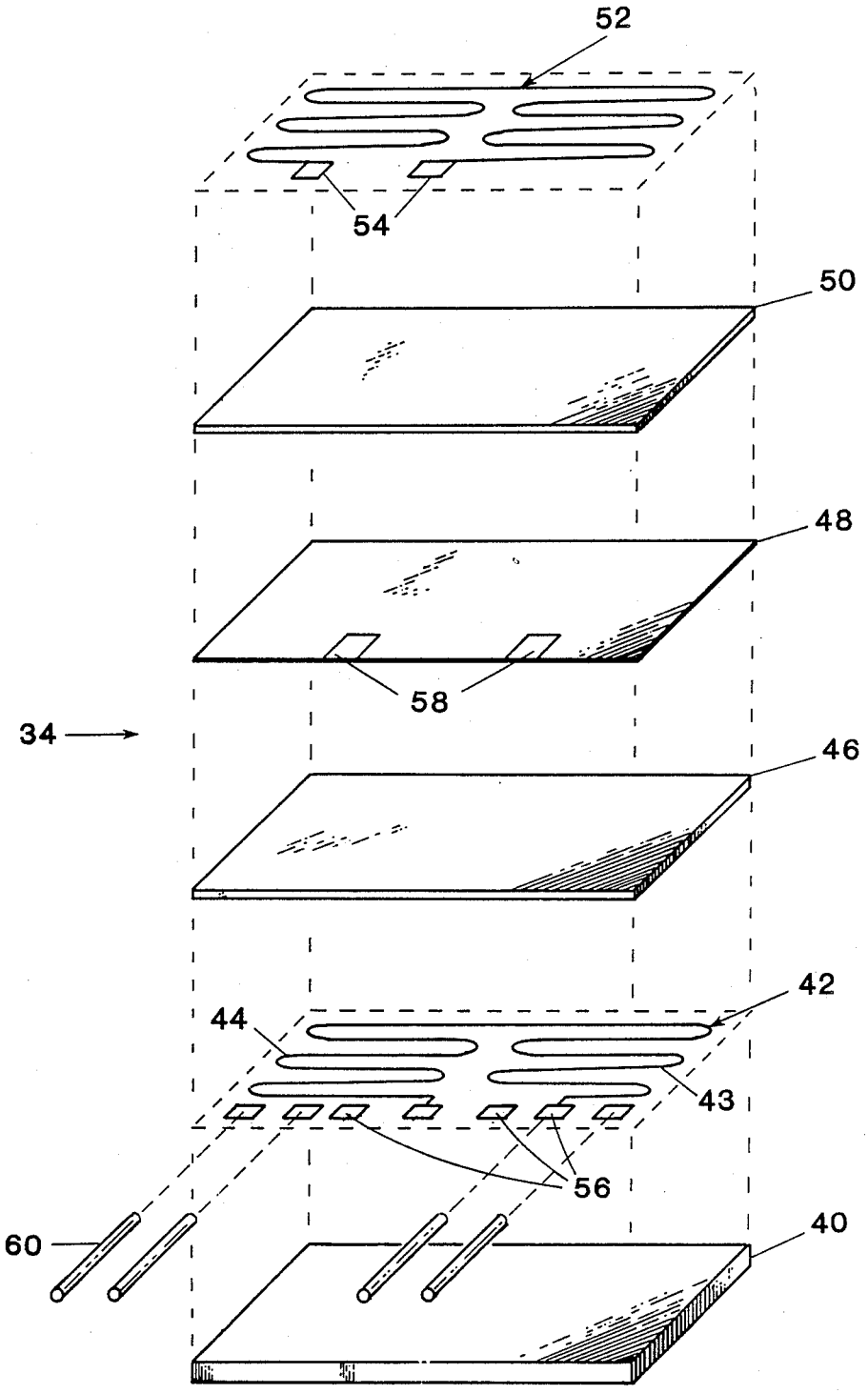
FIG. 5 shows an exploded assembly view of a modular stacked, step and repeat construction including a number of delay line layers interconnected with one another.

Attention is next directed to FIG. 5 wherein still another embodiment of the invention is disclosed which comprises a modularly constructed assembly providing for high-density packaging of a number of transmission lines in a single component to achieve multiple outputs or longer delay values. The assembly 34 of FIG. 5 is formed on a fiber/resin substrate 40 and over which is formed a patterned delay line 42 having right and left sides 43, 44. The delay line 42 is formed with a rolled, foil conductor laminating step with the conductor layer subsequently being etched down to form the conductive pattern 42 shown. Alternatively, a ceramic substrate and sputtering technique and/or the plating technique of FIGS. 1 to 4 might be used.

Formed over the lowermost delay line 42 are a successive screen printed polyimide dielectric layer 46, an evaporated copper ground plane layer 48 and a screen printed polyimide dielectric layer 50. Each of these layers is formed in a fashion using appropriate ones of the process steps previously described.

Lastly, a second transmission line layer 52 similar to that of the transmission line 42 is formed by plating/etching the layer onto the dielectric layer 50. The contact pads 54 of the transmission line 52 are displaced to the left side of the assembly 34 and offset from the contact pads 56 of the lower layer 42. Also provided on the ground plane are contact pads 58. While not readily apparent it is to be appreciated that the contact region of the assembly 34 is provided along one edge of the substrate 40. Each of the layers 46, 48, 50 and 52 thus instead of including a mask formed cutout are actually shortened along this dimension. In any case, ones of the contact pads 56 are exposed at final assembly to permit the solder/bonding of the contact pins 60 thereto. Jumper wires (not shown) appropriately connect others of the contact pads 54 and 58 to the layers 42.

In lieu of jumper wires to the ground plane, vias may be formed by drilling the assembly in a region away from the conductive lines 42, 52 such that the drill holes contact the ground plane 48 and align with conductive lines (not shown) to the ground plane contact pads 54. The vias may then be filled with a solder compound or conductive resin to electrically connect the ground plane to the proper pins 60. Alternatively, too it is to be appreciated each of the delay line layers 42, 52 may be isolated electrically from one another such that two discrete delays are provided by the assembled unit between desired pairs of output pins. Thus, a double density packaging may be obtained with only a slight increase in device thickness, and without sacrificing additional space on the ultimately populated printed circuit board (not shown). In a similar vein it is to be appreciated that the connecting conductor of each of the delay halves 43, 44 might be appropriately severed and/or interconnected with the conductors of the other layer 52 through appropriately formed vias and in combination provide a specifically desired time delay output at the contact pins 58.

Figure 6:
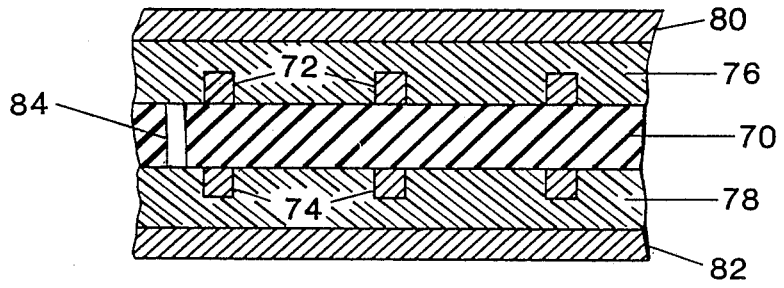
FIG. 6 shows a cross-section view through a multilayered embodiment wherein separate unitary signal layers are formed on opposite sides of the support substrate which is electrically independent of either signal layer.

In the latter regard, FIG. 6 shows a cross-section view through a multi-layered construction having a relatively thick substrate 70 which electrically isolates upper and lower laminated, patterned delay line conductors 72 and 74 from one another. Formed over the conductors in the fashion described previously are relatively thin dielectric layers 76 and 78 and ground plane layers 80 and 82. One or more vias 84 let through the substrate 70 can interconnect the signal layers 72 and 74 with contact pads (not shown), formed as described above, which are used to make external connections at appropriate contact pins (not shown).

While the present invention has been described with respect to its presently preferred and various alternative embodiments, it is to be appreciated that still other embodiments may be suggested to those of skill in the art upon reference hereto. It is accordingly contemplated the following claims should be interpreted to include all those equivalent embodiments within the spirit and scope thereof.

What is claimed is:

1. Thin film delay line apparatus comprising:

(a) an insulative support substrate;

(b) a conductive signal layer deposited over said substrate to provide a patterned serpentine conductor of a predetermined length and weaving back and forth upon itself and terminating in at least first and second contact pads;

(c) a first dielectric layer printed over said signal layer except in the area of said first and second contact pads;

(d) a conductive ground layer deposited over said first dielectric layer except in the area of said first and second contact pads and having third and fourth contact pads thereto;

(e) means for making electrical contact to said first, second, third and fourth contact pads;

(f) means for encapsulating said delay line apparatus; and (g) wherein the inductive and capacitive characteristics of said signal and ground layers and said first dielectric layer relative to one another and between adjacent portions of the serpentine signal layer are such that a signal applied to said first contact pad takes a known time in the range of 1 to 10 nanoseconds to reach said second contact pad.

2. Thin film delay line apparatus comprising:

(a) an insulative support substrate;

(b) a single layer including, (i) a conductive adhesion layer sputtered over at least one surface of said substrate, (ii) a conductive second layer sputtered over said adhesion layer, and (iii) a conductive third layer plated over said second layer and wherein said adhesion, second and third layers are selectively removed from said substrate to define a continuous serpentine signal layer of a predetermined length weaving back and forth upon itself and terminating in at least first and second contact pads;

(c) a first dielectric layer printed over said signal layer and wherein a plurality of apertures are formed therethrough to expose said first and second contact pads;

(d) a conductive ground layer printed over said first dielectric layer, except in the area of said first and second contact pads and having third and fourth contact pads thereto;

(e) means for making electrical contact to said first, second, third and fourth contact pads;

(f) means for hermetically encapsulating said delay line apparatus; and (g) wherein the inductive and capacitive characteristics of said signal and ground layers and said first dielectric layer relative to one another and between adjacent portions of the serpentine signal layer are such that a signal applied to said first contact pad takes a known time in the range of 1 to 10 nanoseconds to reach said second contact pad.

3. Apparatus as set forth in claim 2 wherein said substrate comprises a ceramic material.

4. Apparatus as set forth in claim 2 wherein said substrate comprises a fiber/resin printed circuit board material.

5. Apparatus as set forth in claim 2 wherein said adhesion layer is comprised of a nickel-chrome alloy.

6. Apparatus as set forth in claim 5 wherein said third and ground layers are comprised of a conductor selected from a group consisting of copper, silver, gold, and nickel.

7. Apparatus as set forth in claim 5 wherein said third layer is copper and said ground layer is nickel.

8. Thin film delay line apparatus comprising:

(a) an insulative substrate;

(b) a conductive signal layer deposited over said substrate to provide a patterned serpentine conductor of a predetermined length and electrical resistance weaving back and forth upon itself and terminating in at least first and second contact pads;

(c) a first dielectric layer printed over said signal layer except in the area of said first and second contact pads;

(d) a conductive ground layer deposited over said first dielectric layer except in the area of said first and second contact pads and having third and fourth contact pads thereto;

(e) means for making electrical contact to said first, second, third and fourth contact pads;

(f) means for encapsulating said delay line apparatus; and (g) wherein the inductive and capacitive characteristics of said signal and ground layers and said first dielectric layer relative to one another and between adjacent portions of the serpentine signal layer are such that a signal applied to said first contact pad takes a known time in the range of 1 and 10 nanoseconds to reach said second contact pad.

9. Apparatus as set forth in claim 8 wherein said conductive ground layer comprises nickel.

10. Apparatus as set forth in claim 8 wherein said first dielectric layer includes a dopant from a group consisting of magnetic materials including nickel, iron and cobalt.

11. Thin film delay line apparatus comprising:

(a) an insulative support substrate;

(b) a conductive first signal layer deposited over said substrate to provide a patterned conductor of a predetermined length, weaving back and forth upon itself and terminating in at least first and second contact pads;

(c) a first dielectric layer printed over said first signal layer except in the area of said first and second contact pads;

(d) a conductive ground layer deposited over said first dielectric layer except in the area of said first and second contact pads and having third and fourth contact pads thereto;

(e) a second dielectric layer printed over said ground layer except in the area of said first, second, third and fourth contact pads;

(f) a conductive second signal layer deposited over said second dielectric layer to provide a second patterned conductor or a predetermined length weaving back and forth upon itself and terminating in at least fifth and sixth contact pads thereto;

(g) means for making electrical contact to said first, second, third, fourth, fifth, and sixth contact pads;

(h) means for encapsulating said delay line apparatus; and (i) wherein the inductive and capacitive characteristics between said first and second signal layers, said ground layer and said first and second dielectric layers relative to one another and between adjacent portions of each of the first and second signal layers are such that a signal applied to one of said contact pads takes a known time in the range of nanoseconds to reach a selected other contact pad.

12. Apparatus as set forth in claim 11 wherein said first dielectric layer includes a dopant from a group consisting of magnetic materials including nickel, iron and cobalt.

13. Thin film delay line apparatus comprising:

(a) an insulative support substrate having identical orderings of a plurality of layers formed over upper and lower surfaces of said substrate wherein said identical orderings of layers each comprise;

(i) a conductive signal layer laid over one of said upper and lower surfaces of said surface to provide a serpentine conductor pattern of a predetermined length and weaving back and forth upon itself and terminating in at least first and second contact pads;

(ii) a first dielectric layer laid over said signal layer except in the area of said first and second contact pads; and (iii) a conductive ground layer deposited over said first dielectric layer, except in the area of said first and second contacts, having third and fourth contact pads thereto;

(b) means for making electrical contact to said first, second, third and fourth contact pads on each surface of said substrate;

(c) means for encapsulating said delay line apparatus; and (d) wherein the inductive and capacitive characteristics of said signal and ground layers and said first dielectric layer relative to one another and between adjacent portions of the serpentine signal layer on the upper and lower surfaces are such that a signal applied to one of said contact pads takes a known time in the range of nanoseconds to reach a selected other contact pad.

14. Apparatus as set forth in claim 13 including a plurality of apertures formed through said substrate and filled with an electrical conductor to electrically connect the layers on said upper and lower substrate surfaces.

* * * * *